United States Patent [19]

Love et al.

[11] 4,052,638

[45] Oct. 4, 1977

[54] FLARE-WEDGE LAMP

[75] Inventors: Robert J. Love, Lyndhurst; James C. Graff, Cleveland Heights, both of Ohio

[73] Assignee: General Electric Company, Schenectady, N.Y.

[21] Appl. No.: 661,976

[22] Filed: Feb. 27, 1976

[51] Int. Cl.[2] ..... H01J 5/48; H01J 5/50

[52] U.S. Cl. ..... 313/318; 29/25.1; 29/25.11; 313/315

[58] Field of Search ..... 313/318, 315; 29/25.1, 29/25.11, 25.19

[56] References Cited

U.S. PATENT DOCUMENTS

| | | | |
|---|---|---|---|
| 3,345,526 | 10/1967 | Wright | 313/318 X |
| 3,780,335 | 12/1973 | Stadler | 313/318 |
| 3,857,056 | 12/1974 | Miller et al. | 313/315 |

*Primary Examiner*—Saxfield Chatmon, Jr.

*Attorney, Agent, or Firm*—Paul F. Wille; Lawrence R. Kempton; Frank L. Neuhauser

[57] ABSTRACT

An improved wedge-based lamp and method of manufacture are disclosed in which conductive leads and an exhaust tube are positioned and held in the pinch end of a flared section of glass tubing. After one or more filaments are attached to the leads and accurately positioned relative to the pinch end, an envelope is fastened to the flare to enclose the filaments and the lamp is exhausted or filled with inert gas(es) via the exhaust tube.

16 Claims, 8 Drawing Figures

FLARE-WEDGE LAMP

BACKGROUND OF THE INVENTION

This invention relates to lamps and methods of making lamps and, in particular, relates to what are known as wedge-base lamps.

While not limited thereto, wedge-base lamps have been used primarily in automotive applications. This is due partly to the problem of corrosion facing the automotive industry and partly to the quest for lower cost components. All-glass, wedge-base lamps resist corrosion and are lower in cost since no separate metal base and all-metal socket are required. Also eliminated is the problem of chemical reactions between dissimilar metals, not only between the base and socket, but also between the solder contact and the socket, and chemical reactions involving the flux used with the solder.

With a wedge-base or all-glass lamp, noble materials that resist corrosion can be used in both the lamp and the socket without incurring excessive expense because only small amounts of these materials are required. The lamps are usually made with plated contact wires and the socket may be made with suitably plated contacts.

Despite the attendant advantages of the all-glass lamp, separately based lamps are frequently specified because the filament can be positioned more accurately with respect to some reference point on the base. These lamps are generally utilized with a reflector, in which the filament must be carefully positioned with respect to the focus of the reflector. Since adjustment of the lamp-/socket with respect to the reflector is out of the question in a mass production environment, the filament must be accurately located with respect to the base so that, upon assembly into an automotive stop or taillight for example, accurate positioning is inherent.

It has been difficult to accurately position the filament in wedge-base lamps since the sealing operation removes access to the filament and there is no opportunity to make the post sealing adjustments possible with separately based lamps. However, considerations of cost and corrosion favor utilization of wedge-base lamps if the filament could be positioned within narrower tolerances than present production runs of wedge-base lamps or within tolerances which can now be met only by manual selection of lamps.

In addition, present wedge-base lamps are necessarily entirely made from the same type of glass. For example, glass chosen for optical performance may cause difficulty in sealing the lamp or require more expensive leads to assure an adequate seal. While other lamps have been made with more than one type of glass, e.g., one for the bulb and another for stems, this option has not been available in the manufacture of wedge-base lamps.

SUMMARY OF THE INVENTION

In view of the foregoing, it is therefore an object of the present invention to provide an improved all-glass lamp.

Another object of the present invention is to provide a new method for manufacturing all-glass lamps.

A further object of the present invention is to provide a wedge-base lamp having a more accurately positioned filament.

Another object of the present invention is to provide a new method for manufacturing wedge-base lamps enabling post sealing adjustment of the position of the filament with respect to reference points formed in the pinched end of the lamp.

A further object of the present invention is to provide a new method for manufacturing wedge-base lamps using different types of glass in the same lamp.

Another object of the present invention is to provide a wedge-base lamp having optimum glass characteristics in different portions thereof.

The foregoing objects are achieved in the present invention wherein a section of tubular glass is flared at one end and lead wires and an exhaust tube inserted into the cylindrical part of the tubular section. The cylindrical section is then pressed into a wedge base having reference features. The lead wires are trimmed, bent, and a filament is attached to the lead wires and positioned relative to the reference features on the wedge. Subsequent operations do not affect the filament or base and thus do not upset the positioning of the filament with respect to the reference features. Specifically, an envelope is attached to the flare end and the lamp exhausted or filled with inert gas (es) by way of the exhaust tube.

BRIEF DESCRIPTION OF THE DRAWINGS

A more complete understanding of the present invention can be obtained by considering the following detailed description in conjunction with the accompanying drawings, in which.

DESCRIPTION OF THE PREFERRED EMBODIMENTS

Figure 1:
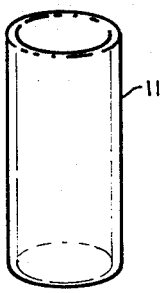
FIG. 1 illustrates a glass tube from which the base is made.

FIG. 1 illustrates a glass tube from which the base is made. Tube 11 may comprise lead or lime glass or a harder glass such as Type 772, also known as Nonex or "electrical" Pyrex. Also suitable for use as the tube are Type 776 glass, yet another type of Pyrex, and quartz. As is known in the art, with the harder glasses, molybdenum or tungsten is used for the lead wires, whereas for the softer glasses, specifically lead glass, the lead wires are made of dumet. For lime glass, the lead wires may comprise nickel-chromium-iron alloy wires. The various combinations of glasses, characteristics, and lead wires are known to those of skill in the art and are summarized herein to indicate the variety of glass that may be chosen for the base independently of the glass chosen for the envelope.

Figure 2:
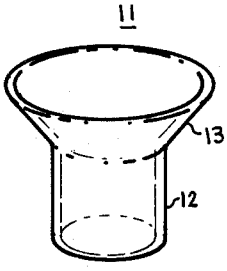
FIG. 2 illustrates the flare used as the base for the lamp.

As illustrated in FIG. 2, the tube has a portion thereof flared to form the frustrum of a cone 13 having the narrow diameter thereof joined to the remainder 12 of tube 11. As known by those of skill in the art, flared portion 13 is formed by softening tube 11 and inserting a rotating die to progressively enlarge the diameter of the softened end of tube 11. While illustrated in FIG. 2 as a frustrum of a cone, this is for the sake of description only. Portion 13 may have any desired shape, e.g., a shell of revolution as formed by the rotation of a curve about an axis.

Figure 3:
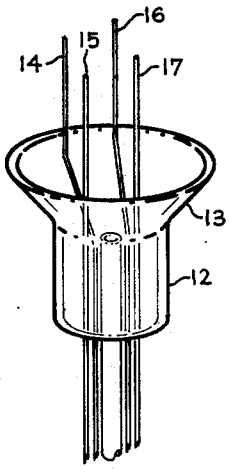
FIG. 3 illustrates the insertion of leads and an exhaust tube.

FIG. 3 illustrates the next step in the fabrication of a lamp in accordance with the present invention in which lead wires 14-17 are inserted through cylindrical portion 12 and flared portion 13. Also inserted through cylindrical portion 12 and extending slightly into flared portion 13 is exhaust tube 18.

Figure 4:
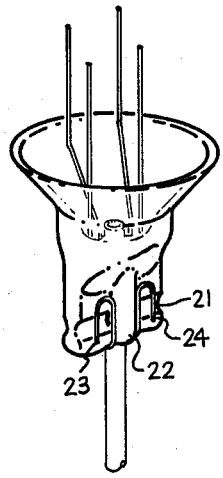
FIG. 4 illustrates a formed base with its attendant exhaust tube.

As illustrated in FIG. 4, the cylindrical portion of the base is softened and pressed to form a pinch end enclosing the lead wires and forming a single unit with exhaust tube 18. As cylindrical portion 12 is pinched and collapsed about exhaust tube 18 and the lead wires, a reference feature, such as groove 21, is formed simultaneously in at least one side of the base. The reference feature may take any desired configuration and is not limited to the groove illustrated in FIG. 4. For example, shoulders or bosses could alternatively or additionally be provided in the pinch end to provide both indexing and filament position references. As is known by those of skill in the art, exhaust tube 18 is not collapsed but is sealed within the pinched end forming a bulging 22 therein. Lead wires 23 and 24 are then suitably shaped and curved back over the pinched end area to provide a contact for the socket in which the lamp will be inserted.

While four lead wires are illustrated in FIGS. 3 and 4, indicating two filaments, it is understood by those of skill in the art that the present invention is not limited to any particular number of filaments. Similarly, while leads 23 and 24 are illustrated as curved back along the pinch area, it is understood that similar leads are formed on the other side of the pinch area or that one pair of lead wires may be joined to provide a common lead for the filaments in the lamp.

Figure 6:
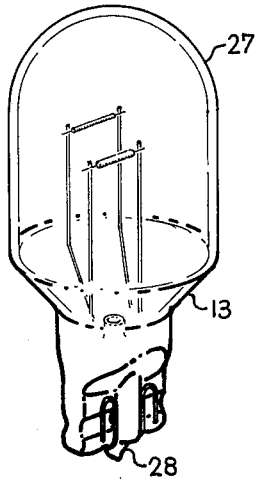
FIG. 6 illustrates a complete lamp.
Figure 5:
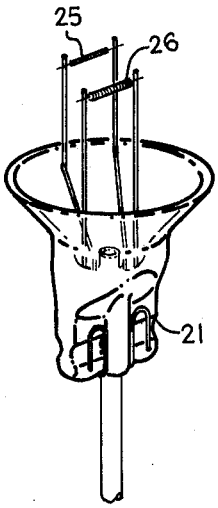
FIG. 5 illustrates a complete lamp mount.

In FIG. 5, filaments 25 and 26 are added to the lead wires, which may be joined thereto by any suitable manner known in the art, for example, by forming a hook in the end of the lead wires and crimping the lead wires about the filament. As can be readily appreciated by inspection of FIG. 5, the pinch end of the lamp containing reference feature 21 is completed, and there is still access to the filaments enabling one to hold the base in a die and accurately position filaments 25 and 26 relative to reference feature 21. After the filaments are positioned, envelope 27 is added as illustrated in FIg. 6, and sealed to the larger diameter of the flare by suitable fires, not shown.

As previously noted, the glass used for the base need not be the same as the glass used for envelope 27. For example, where cost is the dominant consideration, the base may be made out of tubular lead glass, utilizing dumet leads, while envelope 27 comprises lime glass. Utilizing lime glass for envelope 27 means that the envelope can be made on a ribbon bulb blowing machine at minimal cost. After envelope 27 is sealed to the base, the lamp is then evacuated, flushed, filled if desired, and sealed at exhaust tube 28, thereby completing the assembly of the lamp. Thus, the finished lamp may be a single or multiple filament, vacuum, gas, or halogen cycle lamp.

Figure 8:
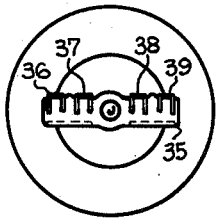
FIG. 8 is an end view of another shape for the base.
Figure 7:
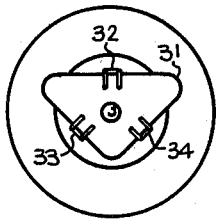
FIG. 7 is an end view of one shape for the base.

The cross section of the base of the lamp may have any desired shape; for example, as illustrated in FIG. 7, the lamp may comprise a triangularly shaped base 31 having leads 32-34. Alternatively, the lamp may comprise an extended rectangular base 35 as illustrated in FIG. 8. Leads 36-39 for the lamp may be positioned all on one side of the base or in various combinations between the two sides of the base.

Thus, the present invention provides a new type of wedge-base lamp and a new method for the manufacture of wedgebase lamps in which the filaments of the lamp can be accurately positioned in three planes with respect to reference features in the base. Once adjusted, the positioning is relatively undisturbed by subsequent lamp-making operations. The rotational orientation of the light source with the wedge base is inherent. The lamp is lower in cost to manufacture since the type of glass chosen for different parts of the lamp can be optimized for the function served and no base or base cement is needed. The same flare-wedge base can be used with a number of different envelope shapes as required by different performance ratings. Internal mount parts can have a wider spacing since there is no bulb neck interference during processing. Finally, the lamp retains the corrosion resistance attributes of wedge-base lamps of the prior art.

Having thus described the invention, it will be apparent to those of skill in the art that various modifications can be made within the spirit and scope of the present invention. For example, the number of filaments, the shape of the flare, and the types of glass, as previously discussed, are all choices open to the lamp maker in tailoring a lamp to a particular application or a type of application. Further, while the present invention, in a sense, inverts the flare utilized in making standard incandescent and fluorescent lamps, in the making of wedge-base lamps, it is understood that the teachings of the present invention apply equally well to making all-glass standard incandescent or all-glass fluorescent lamps as well. In addition, the flare of the lamp in accordance with the present invention can be provided with a reflective coating, separately from the rest of the envelope.

What we claim as new and desire to secure by Letters Patent of the United States is:

1. An all-glass incandescent lamp comprising:

a flare having a cylindrical portion and a conical portion;

at least two conductive leads and an exhaust tube positioned within said flare; and wherein the cylindrical end of said flare is collapsed about said conductive leads and exhaust tube to form a base.

2. The lamp as set forth in claim 1 and further comprising a bulbous envelope attached to the conical portion of said flare.

3. The lamp as set forth in claim 2 wherein the flare and the envelope comprise the same type of glass.

4. The lamp as set forth in claim 1 wherein the flare and the envelope comprise different types of glass.

5. The lamp as set forth in claim 1 comprising at least one filament and wherein said collapsed cylindrical portion contains at least one reference feature from which said filament is located in a predetermined position.

6. The lamp as set forth in claim 3 wherein said lamp comprises two filaments.

7. The lamp as set forth in claim 3 wherein said lamp comprises a halogen fill gas.

8. An all-glass lamp comprising:

a flare comprising a shell of revolution, a portion of which forms a cylinder;

at least one pair of lead wires extending through said flare and at least one filament connected to said lead wires at the ends opposite said cylindrical portion;

an exhaust tube extending through the cylindrical portion of said flare, said cylindrical portion being collapsed about said lead wires and exhaust tube to form a pinch end, and p1 an envelope sealed to the open end of said flare enclosing said filament.

9. The lamp as set forth in claim 8 wherein said envelope is bulbous.

10. The lamp as set forth in claim 8 wherein said envelope is tubular.

11. A method for manufacturing an all-glass incandescent lamp comprising the steps of:

softening and enlarging one end of a section of glass tubing to form a flare;

collapsing the other end of said section of tubing about lead wires and an exhaust tube to form a pinch end;

mounting at least one filament on the ends of the lead wires extending from the flared end of said section;

sealing an envelope to the flared end of said section to form an enclosed space;

evacuating said enclosed space by way of said exhaust tube; and sealing off said exhaust tube while maintaining a predetermined pressure in said lamp.

12. The method as set forth in claim 11 wherein said mounting step is followed by the step of:

adjusting at least one filament to a predetermined spatial relationship with said pinch end.

13. The method as set forth in claim 12 wherein said collapsing step includes the formation of at least one reference feature in said pinch end and wherein said adjustment is made relative to said reference feature.

14. The method as set forth in claim 11 wherein said evacuating step is followed by the step of:

filling said enclosed space with a predetermined fill gas.

15. The method as set forth in claim 14 wherein said fill gas comprises a gaseous halogen compound.

16. The method as set forth in claim 11 further including the step of:

forming said lead wires about said pinch end to provide contacts for said lamp.

* * * * *